US005925274A

United States Patent [19]

McKinney et al.

[11] Patent Number: 5,925,274

[45] Date of Patent: Jul. 20, 1999

[54] ELECTRICAL RANGE POWER OVERRIDE TIMER UNIT

[76] Inventors: Duane M. McKinney, 1700 W. 15th Ave., Apache Junction, Ariz. 85220; Elwin B. Johnson, 1252 Zephyr Way, Jacksonville Beach, Fla. 32250

[21] Appl. No.: 08/889,913

[22] Filed: Jul. 10, 1997

Related U.S. Application Data

[60] Provisional application No. 60/021,593, Jul. 11, 1996.

[51] Int. Cl.[6] ..... H05B 1/02

[52] U.S. Cl. ..... 219/492; 219/493; 219/508; 219/412; 219/414; 340/309.15

[58] Field of Search ..... 219/412–414, 219/483–486, 506, 501, 492, 493, 508; 340/309.15, 309.6

[56] References Cited

U.S. PATENT DOCUMENTS

| | | | |
|---|---|---|---|
| 4,062,007 | 12/1977 | Scott | 340/309.1 |
| 4,210,824 | 7/1980 | Marquis et al. | 307/141 |
| 4,675,478 | 6/1987 | Song | 200/38 R |
| 4,713,528 | 12/1987 | Hirata | 219/492 |
| 5,046,157 | 9/1991 | Smith et al. | 340/309.15 |
| 5,073,701 | 12/1991 | Ljunggren | 219/448 |
| 5,289,158 | 2/1994 | Neves | 340/309.15 |
| 5,398,597 | 3/1995 | Jones et al. | 99/330 |
| 5,438,180 | 8/1995 | Eisenbrandt et al. | 219/492 |

*Primary Examiner*—Mark Paschall
*Attorney, Agent, or Firm*—Joseph N. Breaux

[57] ABSTRACT

An electric range override timer unit including an electrically controllable power interrupt circuit positioned between a conventional male power plug adapted for connection with an existing electrical wall socket and a socket assembly adapted for receiving the male plug from an existing electric range; a timer unit in electrical connection with the power interrupt circuit, the timer unit having a timing mechanism having a predetermined maximum time period for sending a control signal to the power interrupt circuit for causing the power interrupt circuit to conduct electrical current between the conventional male power plug and the socket assembly; and a mounting bracket having a first portion secured to the timer unit and a second portion adapted for multiple connecting modes to an existing electric range.

1 Claim, 2 Drawing Sheets

ELECTRICAL RANGE POWER OVERRIDE TIMER UNIT

TECHNICAL FIELD

This application claims the benefits under 35 U.S.C. 119(e) of earlier filed provisional application Ser. No. 60/021,593, filed Jul. 11, 1996. The present invention relates to home safety devices and more particularly to a timer unit that is securable to an existing electric range with a timer securing bracket that controls a power interrupt circuit that can be placed between an electric range and the electrical power supply plug. The timer has a predetermined maximum time period that allows the user to put the power interrupt circuit into a conducting state in which electrical power is supplied to the range. The timer may be reset periodically by the user in order to continue supplying power to the range.

BACKGROUND ART

Each year many fires occur because an electric range was left on and unattended for an extended period of time. The range can be left unattended for many reasons. However, many individuals such as the physically and mentally infirm are particularly prone to leaving the range on and unattended. It would be a benefit, therefore, to have a safety device that could automatically interrupt power to an electrical range after a predetermined time period has elapsed. It would be a further benefit if the device could be easily installed on existing electric ranges so that persons with limited incomes could have access to the safety device.

GENERAL SUMMARY DISCUSSION OF INVENTION

It is thus an object of the invention to provide an electric range override timer unit that will automatically interrupt power to an electrical range after a predetermined time period has elapsed.

It is a further object of the invention to provide an electric range override timer unit that can be easily installed on existing electric ranges.

It is a still further object of the invention to provide an electric range override timer unit that accomplishes both of the above objects in combination.

Accordingly, an electric range override timer unit is provided. The override timer includes an electrically controllable power interrupt circuit positioned between a conventional male power plug adapted for connection with an existing electrical wall socket and a socket assembly adapted for receiving the male plug from an existing electric range; a timer unit in electric electrical connection with the power interrupt circuit in a manner to control the conducting state of the power interrupt circuit, the timer unit having a timing mechanism having a predetermined maximum time period for sending a control signal to the power interrupt circuit for causing the power interrupt circuit to conduct electrical current between the conventional male power plug and the socket assembly; and a mounting bracket having a first portion secured to the timer unit and a second portion adapted for multiple connecting modes to an existing electric range. The power interruption circuit is preferably a 220 Volt electrical contactor controlled by the control output from the timer unit.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
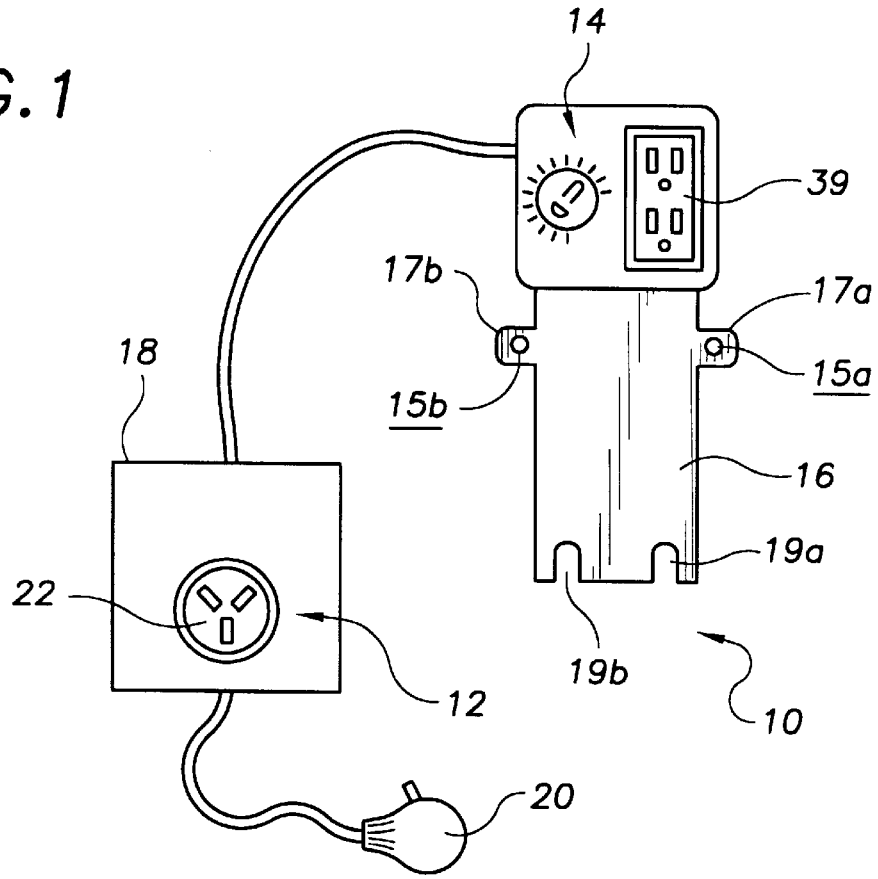
FIG. 1 is a plan view of an exemplary embodiment of the electric range override timer unit of the present invention.

FIG. 1 shows an exemplary electric range override timer unit of the present invention generally designated by the numeral 10. Override timer unit 10 includes an electrically controllable power interrupt circuit, generally designated by the numeral 12, a timer unit, generally designated by the numeral 14, and a mounting bracket 16 having two outwardly extending portions 17*a*,17*b* having screw apertures 15*a*,15*b* formed therethrough and two screw slots 19*a*,19*b* formed into a bottom portion 21 thereof.

Figure 2:
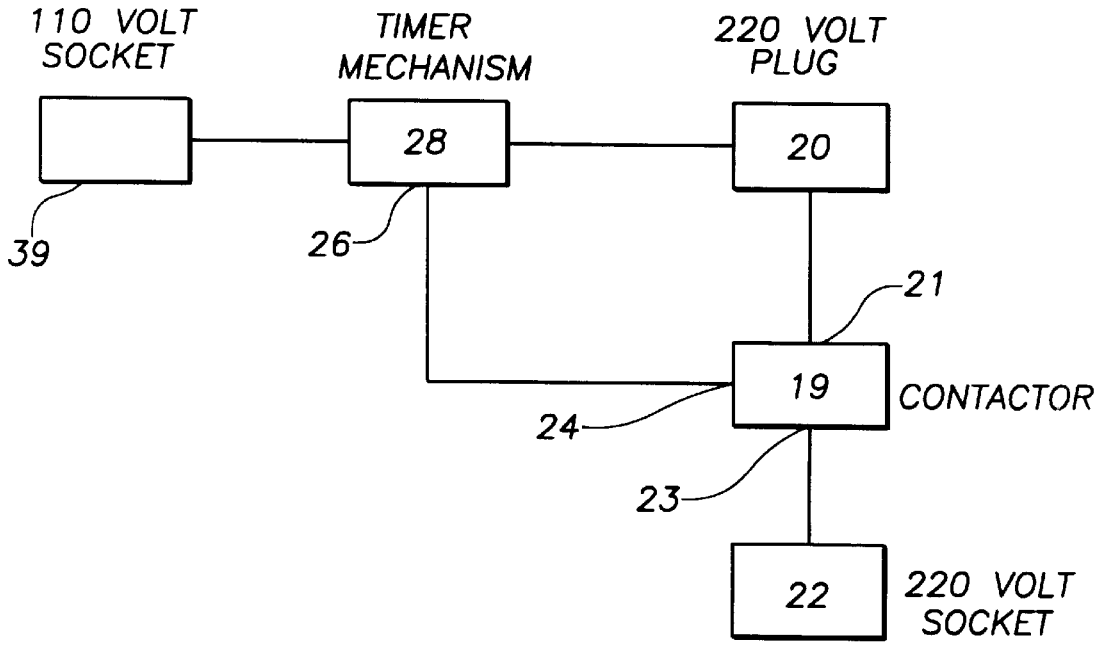
FIG. 2 is a schematic diagram showing the functional and electrical connections between the timer unit and the power interrupt circuit.

In this embodiment power interrupt circuit 12 is housed within a power interrupt housing 18 and includes a conventional 220 Volt contactor 19 having its contacts 21,23 (shown in FIG. 2) wired between a conventional male 220 Volt plug 20 and a conventional female 220 Volt socket 22. With reference to FIG. 2, the control input 24 of contactor 19 is wired to the control output 26 of a timer mechanism 28 forming a portion of timer unit 14. Timer mechanism 28 is a conventional timer mechanism having a thirty minute maximum time period and a high voltage output at control output 26 when the timer is running. When timer mechanism 28 times out, the voltage supplied by control output 26 is zero. When control input 24 receives a high voltage input, contactor 19 closes its contacts 21,23 completing the circuit across contactor 19 allowing current to flow from the wall outlet to the electric range. When control input 24 loses a voltage input, contactor 19 opens its contacts 21,23 interrupting current flow through contactor 19 and interrupting current flow between the wall outlet to the electric range. In this embodiment, timer unit 14 also includes a pair of conventional 110 Volt sockets 39 that are controlled in the same manner as contactor 19.

Figure 3:
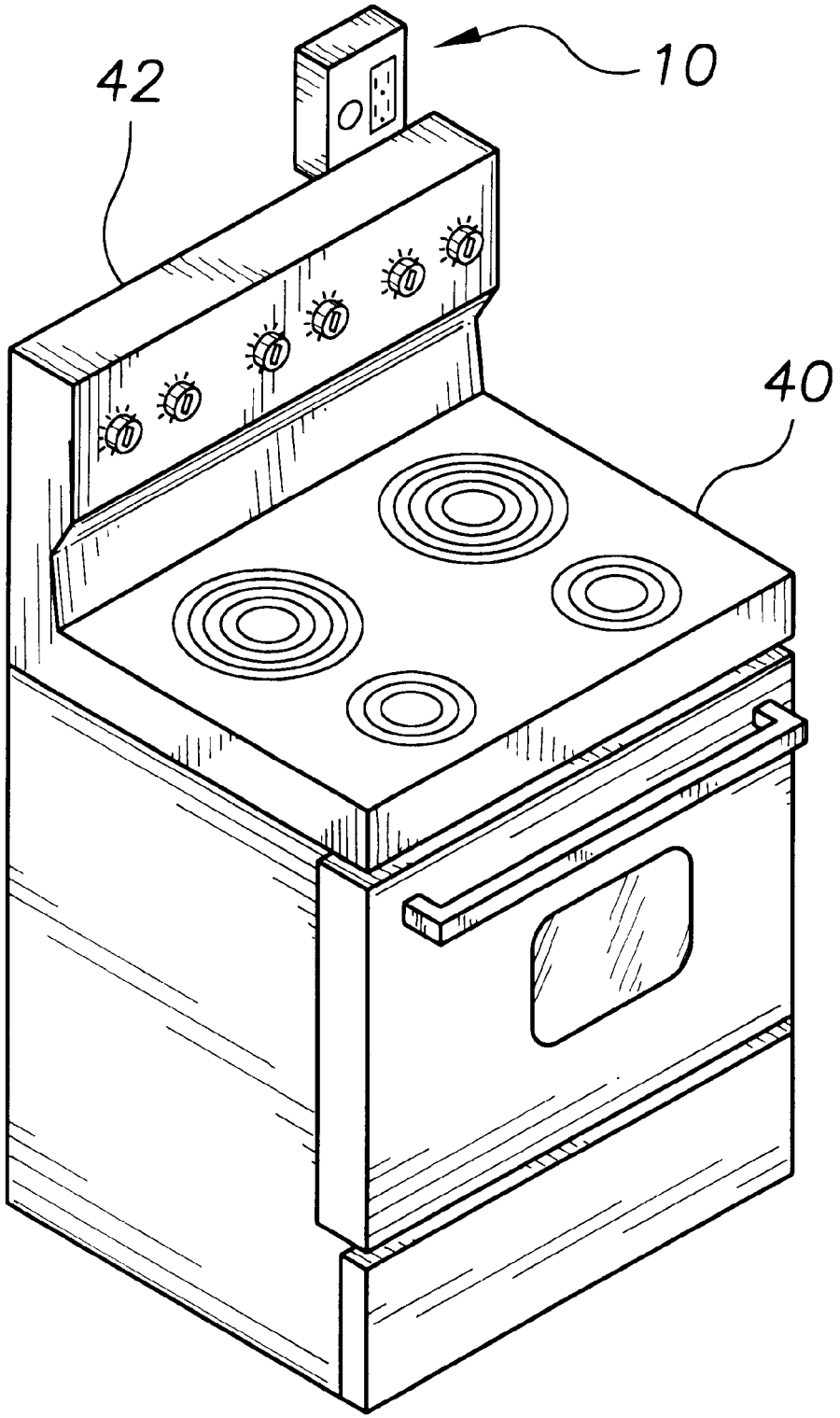
FIG. 3 is a perspective view of a representative electric range with the exemplary electric range override timer unit installed.

With reference to FIG. 3, electric range override timer unit 10 is shown installed to a representative range 40. With general reference to FIGS. 1–3, timer unit 14 is attached to the back panel 42 of range 40 by four self-drilling screws (not shown) that are inserted through screw apertures 15*a*, 15*b* and screw slots 19*a*,19*b* and then into back panel 42. Once timer unit 14 is secured to range 40, installation is completed by conventional male 220 Volt plug 20 is inserted into the existing power outlet and the existing range plug is inserted into conventional female 220 Volt socket 22. Use of electric range override timer unit 10 is simple. To use range 40 or conventional 110 Volt sockets 39, timer mechanism 28 is set to a desired time up to the predetermined upper time limit. Use of range 40 and sockets 39 is then in the conventional fashion. If it is desired to use range 40 for a period of time longer than the predetermined maximum time period, timer mechanism 28 must be periodically reset. This insures that range 40 will not be left unattended while in the on state for a period extending the maximum predetermined time period.

It can be seen from the preceding description that an electric range override timer unit has been provided that automatically interrupts power to an electrical range after a predetermined time period has elapsed; and that can be easily installed on existing electric ranges.

It is noted that the embodiment of the electric range override timer unit described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An electric range power override timer unit comprising:

an electrically controllable power interrupt circuit positioned between a conventional male power plug adapted for connection with an existing electrical wall socket and a socket assembly adapted for receiving said male plug from an existing electric range;

a timer unit in electrical connection with said power interrupt circuit in a manner to control said conducting state of said power interrupt circuit, said timer unit having a timing mechanism having a predetermined maximum time period for sending a control signal to said power interrupt circuit for causing said power interrupt circuit to conduct electrical current between said conventional male power plug and said socket assembly; and a mounting bracket having a first portion secured to said timer unit and a second portion adapted for multiple connecting modes to an existing electric range, said timer unit including a pair of conventional 110 Volt sockets in controlled connection with said timer unit;

said power interruption circuit being a 220 Volt electrical contactor controlled by said control signal from said timer unit;

said mounting bracket having two outwardly extending portions having two screw apertures formed therethrough and two screw slots formed into and through a bottom portion thereof;

said power interrupt circuit being housed within a power interrupt housing;

said timer mechanism has a thirty minute maximum time period.

* * * * *